US005314354A

United States Patent [19]

Nomura et al.

[11] Patent Number: 5,314,354

[45] Date of Patent: May 24, 1994

[54] FUSE BOX

[75] Inventors: Fumihiko Nomura, Kanagawa; Yuji Maeda; Tomotoshi Kamiyama, both of Shizuoka, all of Japan

[73] Assignee: Yazaki Corporation, Tokyo, Japan

[21] Appl. No.: 917,675

[22] Filed: Jul. 22, 1992

Related U.S. Application Data

[63] Continuation of Ser. No. 712,275, Jun. 11, 1991, abandoned.

[30] Foreign Application Priority Data

Jun. 15, 1990 [JP] Japan ..... 2-62695[U]

[51] Int. Cl.[5] ..... H01R 13/68

[52] U.S. Cl. ..... 439/621

[58] Field of Search ..... 439/622, 621

[56] References Cited

U.S. PATENT DOCUMENTS 4,274,698 6/1981 Ahroni ..... 439/622

FOREIGN PATENT DOCUMENTS 54-181243 12/1979 Japan .
58-104553 7/1983 Japan .
59-115544 8/1984 Japan .
60-138236 9/1985 Japan .
61-159822 10/1986 Japan .
62-61281 3/1987 Japan .
62-130054 8/1987 Japan .
63-109453 7/1988 Japan .

*Primary Examiner*—Gary F. Paumen
*Attorney, Agent, or Firm*—Armstrong, Westerman, Hattori, McLeland & Naughton

[57] ABSTRACT

A fuse box having a housing formed with a first, second, and third openings therein. A screw-fastened type fuse having two terminals is inserted into the housing through the second opening. Conductors connected to the fuse are directed to external circuits through the first opening. The third openings oppose the terminals of the fuse inserted and have guide grooves. Each of the terminals is connected together with the conductors to the housing by means of a bolt inserted through the third opening. A cover is attached to the second opening after the terminals of fuse are securely connected to the housing together with the conductors. The cover is formed with a lid continuously integral with the cover and the lid is accepted and guided by the guide grooves to close the third opening when the cover is assembled to the housing.

3 Claims, 4 Drawing Sheets

FUSE BOX

This application is a continuation of application Ser. No. 07/712,275 filed Jun. 11, 1991 now abandoned.

BACKGROUND OF THE INVENTION

1. Field of the Invention

The present invention relates to a fuse box having a housing body and an undercover, and more particularly to a fuse box in which the connections of screw-fastened type fuses installed in the housing are enclosed simultaneously with the assembly of the undercover to the housing as well as the detection of a screw left loosely tightened while assembling the undercover to the housing.

2. Prior Art

FIG. 6 shows one such conventional fuse box. In the figure, a housing 23 made of synthetic resin is formed with a chamber therein having an opening 25 on the top of the housing 23. Through the opening 25 is inserted a screw-fastened type fuse 24. The fuse 24 has a pair of terminals 26, each of which opposes openings 28 formed in two opposing walls 27 of the housing 23 when the fuse is inserted. Each of the openings 28 is adapted to be closed by an insulating door 30 which is integrally continuous with the housing 23 via a thin hinge 29. The door 30 is firmly closed to the housing by means of a claw 31. The respective terminal 26 of the fuse 24 is formed with a hole **26*a* therein through which a bolt 34 is inserted. The fuse 24 is inserted through the opening 25 and firmly fixed by screwing the bolt 34 into a nut(-not shown) embedded in the housing 23 through the hole 26*a* in the terminals 26 and a hole in a terminal crimped with a wire 32. With the two wires 32 extending downwards from the housing 23, the door 30 is first closed and then an undercover 36 is assembled to a bottom opening 35. The undercover 36 has resilient clamping-straps 37 that engage projections 38 on the lower portion of the housing 23** for firm attachment.

However, with the aforementioned conventional fuse box, when assembling the fuse 24 and terminals 33 on the wire to the housing 23, the opening and closing of the door 30 and the assembly of the undercover 36 are involved. It is time consuming and difficult to align the projections 37 of the undercover 36 with the projections 38 on the housing 23. Sometimes the hinges of the doors 30 are damaged because of frequent and rough opening and closing operation during replacement of the fuse. Additionally, high molding technique is required to form a thin hinge 29 and therefore the mold used is of a large size. This makes the manufacture cost of the housing 23 high. The conventional fuse box also suffers from the drawback that a workman cannot become aware when he inadvertently closes the door 30 with the bolt 34 left loosely tightened.

SUMMARY OF THE INVENTION

An object of the present invention is to provide a fuse box which offers good assembly efficiency.

Another object of the invention is to provide a fuse box which can be manufactured with a low cost mold.

Another object of the invention is to provide a fuse box that will provide some indication to a workman if he forgets to tighten the bolt to fix the wire and the fuse firmly to the housing.

A fuse box according to the present invention has a housing which is formed with a first, second, and third openings therein. Conductors or wires are directed to the outside of the housing through the first opening so as to be connected to an external circuit. A screw-fastened type fuse having two terminals is inserted into the housing through the second opening. The third openings oppose the terminals of the fuse inserted. Each of the terminals is connected together with the conductors to the housing by means of a bolt inserted through the third opening. A cover is attached to the first opening after the terminals of fuse are securely connected to the housing together with the conductors. The door is formed continuously integral with the undercover and the undercover is assembled to the housing through sliding movement of the door into fitting relation with the housing.

BRIEF DESCRIPTION OF THE DRAWINGS

Features and other objects of the present invention will be more apparent from the detailed description of the embodiment with reference to the accompanying drawings in which.

DETAILED DESCRIPTION OF THE EMBODIMENTS

Figure 1:
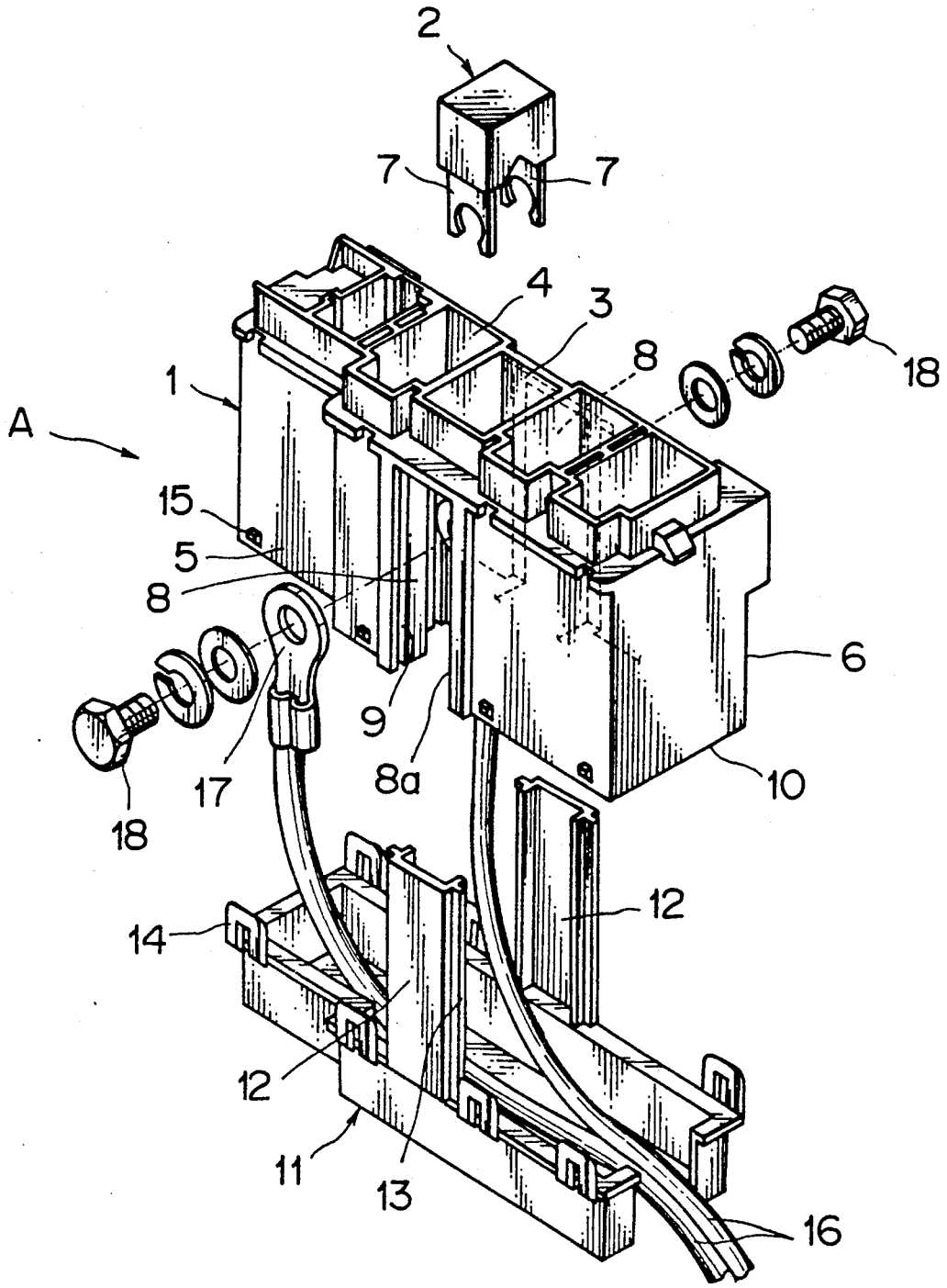
FIG. 1 is an exploded perspective view of a fuse box according to the present invention.

FIG. 1 shows a fuse box according to the present invention. A housing 1 made of synthetic resin is formed with an opening 3 therein on the top thereof. Through the opening 3 is inserted a screw-fastened type fuse 2, and on the left and right sides of the opening 3 are provided openings 4 into which ordinary plug-in type fuses, not shown, are inserted. Two opposing walls 5 and 6 of the housing 1 are formed with openings 8 therein in the form of a cutout, each of which faces a terminal 7 of the fuse 2. Each of the openings 8 has a guide groove 9 formed in two opposite side edges **8*a* thereof. An undercover 11 has two opposing insulation doors or lids 12 that are in upright position and in alignment with the openings 8. The respective insulation lid 12 has projections 13 on its two edges that extend over the entire length of the insulation lid. The undercover 11 has a plurality of resilient clamp straps 14 on its periphery which engage projections 15 provided on the lower end portion of the housing 1 for registration and firm assembly of the housing 1 and undercover 11. The fuse 2 inserted through the opening 3 is firmly fixed by tightening a bolt inserted through a hole in a terminal 17 crimped with a wire 16 and a hole of the terminal 7 into a later described nut 19 in the housing 1. When the undercover 11 is assembled to the housing 1 at the bottom opening 10, with the two wires 16 extending downwards from the housing 1, the undercover 11 is guided by sliding engagement of the projections 13 with the guide grooves 9. The undercover 11 is then firmly assembled to the housing 1 through hook engagement of projections 15 with resilient straps 14**.

Figure 2:
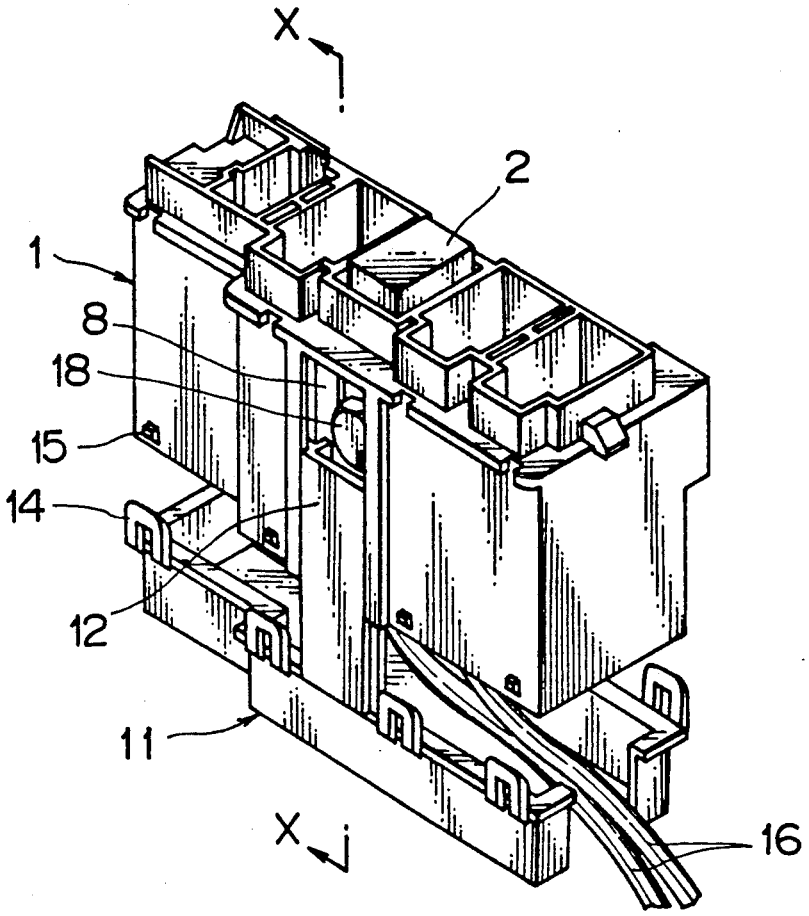
FIG. 2 is a perspective view showing a fuse box of FIG. 1 when it is being assembled.

FIG. 2 is a perspective view showing a fuse box of the invention when it is assembled through sliding engagement of the projections 13 with the guide grooves 9. This assembly operation allows the closure of the door or lid 12 simultaneously with the assembly operation of the undercover 11 as well as facilitates the assembly operation of the undercover 11.

Figure 3:
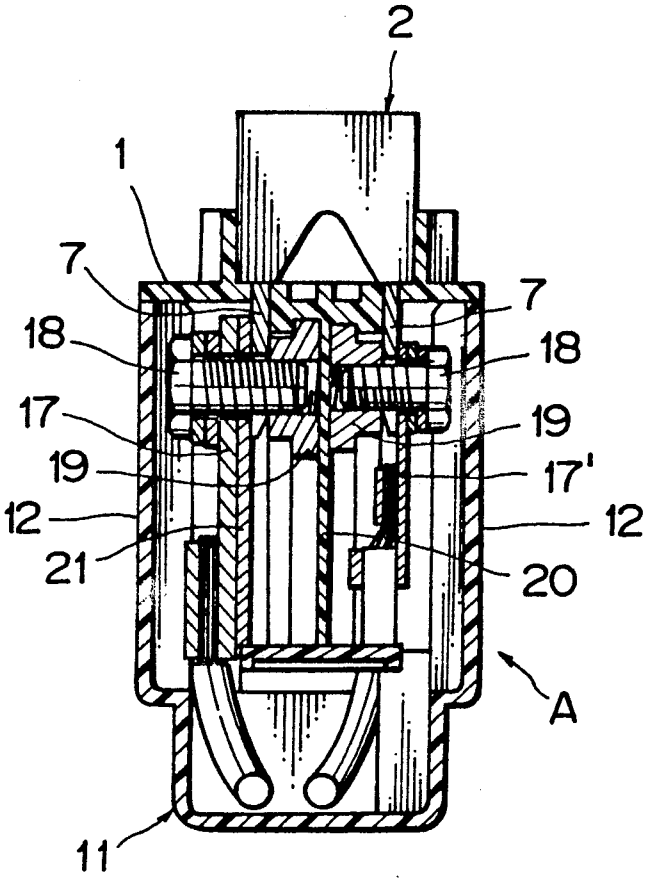
FIG. 3 is a cross-sectional view taken along the line X—X of FIG. 2.
Figure 4:
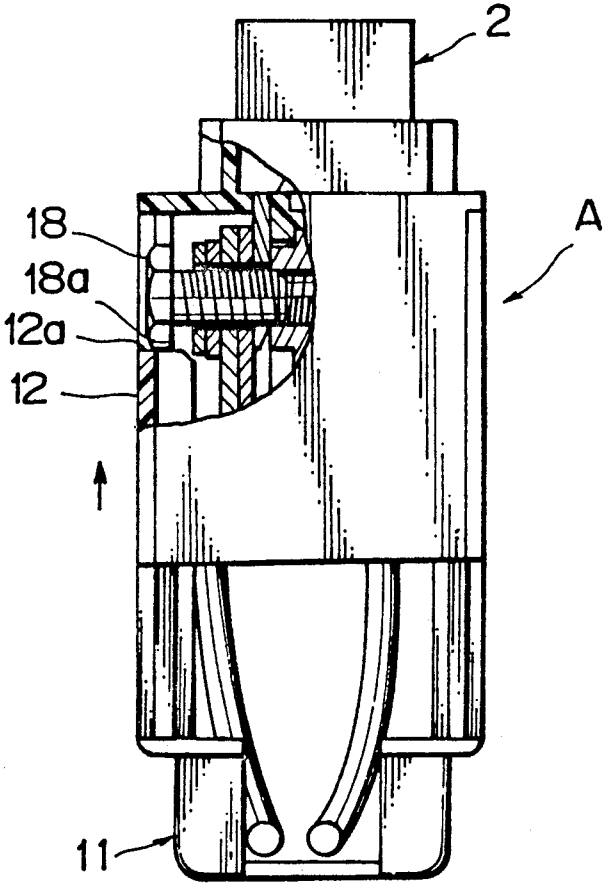
FIG. 4 is a partly cross-sectional view showing how a bolt left loosely tightened is detected.
Figure 6:
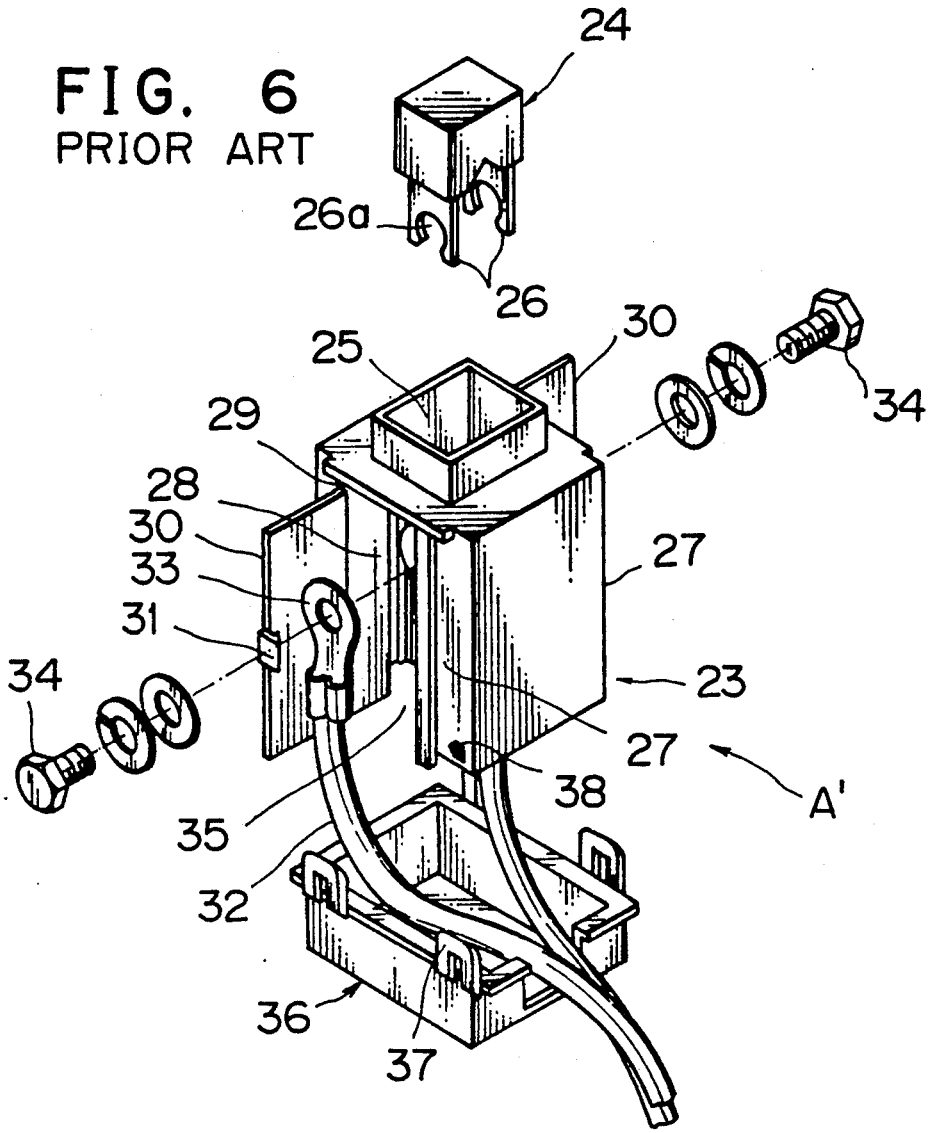
FIG. 6 PRIOR ART
FIG. 6 is an exploded view showing a prior art fuse box.

FIG. 3 is a cross-sectional view taken along the line X—X of FIG. 2 and shows the fuse box when the undercover 11 has been assembled to the housing 1. In the figure, the respective bolt is inserted through the terminal 17 on the wire 16, common ground plate 21 that is associated with other fuses inserted into the openings 4 and 8, and terminal 7, and is tightened into the nut 19 securely attached to a partition 20.

Figure 5:
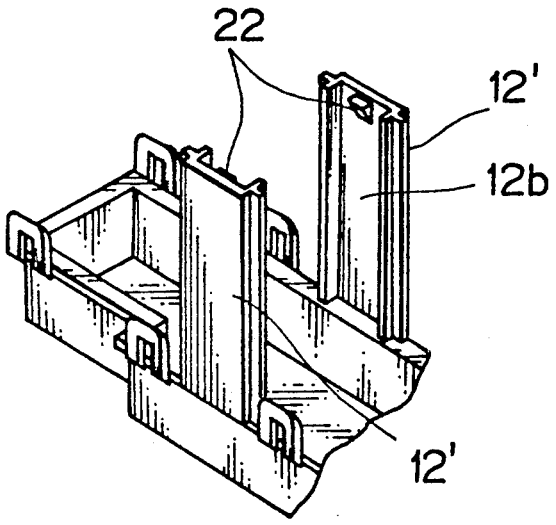
FIG. 5 is a perspective view of an undercover having projections 22.

If the workman forgets to tighten the bolt 18 and tries to attach the undercover 11, the head 18*a* of the bolt 18 disrupts sliding movement of the lid 12 into the housing and thus prevents the bolt from being left not tightened. Thus, the undercover cannot be assembled properly and the workman becomes aware that he did not assemble the fuse properly. A projection 22 may be provided on the inner surface of the lids 12 as shown in FIG. 5 to ensure the detection of the head 18*a* when the insulation lid 12 slides into the housing 1.

What is claimed is:

1. A fuse box comprising:

a housing;

at least one first opening formed in said housing, said first opening receiving a screw-fastened type fuse having two terminals inserted through said first opening;

a second opening formed in said housing, said second opening receiving and directing conductors connected to said terminals to external circuits;

two opposing third openings formed in said housing, said third openings receiving bolts inserted into said housing and threaded into apertures in said housing to mechanically secure said terminals together with said conductors to said housing and to electrically connect said terminals with said conductors, said third openings facing said terminals of the fuse when the fuse is inserted and having guide grooves spaced a predetermined distance from said apertures in said housing; and a cover for covering said second opening, said cover having two opposing lids formed continuously integral therewith and an opening through which said conductors are directed from said second opening to the external circuits, said two opposing lids are adapted to be slidably guided and accepted by said guide grooves to close said third openings when said cover is assembled to the housing and said bolts are fully threaded into the housing to press said terminals and said conductors between said bolts and said housing, and said bolts prevent closure of the two opposing lids when at least one of said bolts is not fully threaded into said housing.

2. A fuse box according to claim 1, wherein each of said lids has a projection for fitting into one of said guide grooves.

3. A fuse box according to claim 1, wherein said housing further includes at least one projection on a wall thereof and said cover further includes at least one clamp strap which moves into hooked engagement with said projection when said lids are guided to close said third openings, whereby said cover is secured to said housing.

* * * * *